US006364464B1

(12) United States Patent
Ahn

(10) Patent No.: US 6,364,464 B1
(45) Date of Patent: Apr. 2, 2002

(54) SPRAY DEVICE FOR INK-JET PRINTER AND ITS SPRAYING METHOD

(75) Inventor: Byung-Sun Ahn, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 08/888,650

(22) Filed: Jul. 7, 1997

(30) Foreign Application Priority Data

Jul. 4, 1996 (KR) ..... 96-27127

(51) Int. Cl.[7] ..... B41J 2/05
(52) U.S. Cl. ..... 347/61
(58) Field of Search ..... 347/56, 61, 47, 347/54

(56) References Cited

U.S. PATENT DOCUMENTS 4,164,745 A * 8/1979 Cielo et al. ..... 347/56
4,275,290 A * 6/1981 Cielo et al. ..... 347/61
4,502,054 A * 2/1985 Brescia et al. ..... 347/55
4,893,191 A * 1/1990 Tanaka et al. ..... 358/298
5,368,683 A * 11/1994 Altavela et al. ..... 216/27
5,417,897 A * 5/1995 Asakawa et al. ..... 264/22
5,434,607 A * 7/1995 Keefe ..... 347/50
5,595,785 A * 1/1997 Hindagolla et al. ..... 427/271
5,682,188 A * 10/1997 Meyer et al. ..... 347/61
5,787,327 A * 7/1998 Matsushita et al. ..... 399/130
5,790,142 A * 8/1998 Uchinami et al. ..... 347/15
5,831,660 A * 11/1998 Kubo et al. ..... 347/238

FOREIGN PATENT DOCUMENTS

JP 2-185446 * 7/1990 ..... 347/61

* cited by examiner

*Primary Examiner*—John Barlow
*Assistant Examiner*—Michael S Brooke
(74) *Attorney, Agent, or Firm*—Robert E. Bushnell, Esq.

(57) ABSTRACT

Provided is a spray device of an inkjet printer, made up of a plurality of individual electrodes formed on an oxide layer $SiO_2$ on a silicon substrate and having a predetermined portion wetted with an ink to generate bubbles in the ink with the remaining portion serving as an insulating layer; a nozzle plate made of a plurality of openings for spraying an ink onto media, conductive layers surrounding the openings, and insulating layers covering the conductive layers, the nozzle plate being separated from the plurality of individual electrodes, and formed on different layers, the nozzle plate having a predetermined portion wetting with the ink and serving as a common electrode to generate bubbles in the ink with electrical energy supplied from the individual electrodes; a barrier for serving as a guiding wall, which electrically separates the portion wetting with the ink in the individual electrodes from the adjacent individual electrodes and supplies the ink transmitted from an ink via through an ink channel to an ink chamber; an ink chamber for receiving the ink through the barrier and generating bubbles with the current density between the individual electrodes and the nozzle plate; and electrical connecting means for supplying electrical energy to the individual electrodes and the nozzle plate.

24 Claims, 9 Drawing Sheets

SPRAY DEVICE FOR INK-JET PRINTER AND ITS SPRAYING METHOD

CLAIM OF PRIORITY

This application makes reference to, incorporates the same herein, and claims all benefits accruing under 35 U.S.C. §119 from an application for SPRAY DEVICE FOR INK-JET PRINTER AND ITS SPRAYING METHOD earlier filed in the Korean Industrial Property Office on Jul. 4, 1996 and there duly assigned Ser. No. 27127/1996.

FIELD OF THE INVENTION

The present invention relates to a spray device for an inkjet printer and a spraying method thereof. More particularly, the invention relates to a spray device of an inkjet printer and its spraying method, capable of preventing energy leakage by structuring a predetermined area which does not wet with an ink in a nozzle plate of a common electrode as an insulating layer, in a spray device for performing printing by applying a low voltage between two electrodes from different layers, generating bubbles in an ink chamber with Joule heat from the conductive ink and spraying the ink to opening with a vapor pressure.

DISCUSSION OF RELATED ART

The use of conductive ink heated between two electrodes and the use of a narrow opening in the nozzle plate for expelling ink onto the print media is demonstrated in U.S. Pat. No. 5,400,061 for an *Ink-Jet Printer Head* to Horio et al. The ink is heated inside a chamber between two electrodes of opposite polarity and is expelled through a relatively narrow discharge hole in the nozzle plate of the device. However, the two electrodes are kept away from the nozzle plate, and are both located on a base plate underneath the conductive ink chamber. I have not seen an ink spray nozzle where one of the two electrodes is located on the nozzle plate or about the discharge hole of the chambered device.

SUMMARY OF THE INVENTION

Accordingly, the present invention is directed to a spray device of an inkjet printer and its spraying method that substantially obviates one or more of the problems due to limitations and disadvantages of the related art.

An object to provide a spray device for an inkjet printer where a surface of a nozzle plate used for a common electrode is equally coated as an insulating layer, and an inner side, namely, a side of an ink chamber is made of a conductor, so that the spray device has a simple structure, an easy fabrication, and prevents the loss of power.

Another object is to provide a spray device of an inkjet printer and its method thereof, preventing the centering of the current density and the loss of power caused therefrom, so that alow voltage operation and a uniformity in positions of the generated bubbles are settled and thus the drops are straightly printed.

Another object is to provide a spray device of an inkjet printer and its spraying method, increasing a current density around the firstly generated bubble, successively forming bubbles around the area and deforming them to thereby increase the entire vapor pressure.

Still another object is to provide a spray device for an inkjet printer and its spraying method, coating a predetermined opening of a nozzle plate with a conductive layer to stabilize a flow of a current density generated in a conductive ink by electrical energy applied to two electrodes in a chamber of the ink spray device, thereby enhancing the quality of printing.

Yet another object is to provide a spray device for an inkjet printer an its spraying method, structuring a nozzle plate into multiple layers by forming surface wetted with an ink in an ink chamber in a nozzle plate as a conductive layer made of Ni or Platinum alloy, and also forming the other surface facing media as an insulating layer, to thereby center the energy generated through the conductive ink, and prevent the power leakage.

Still another object is to provide one of the two electrodes that electrify the conductive ink in the discharge hole of the nozzle plate of the spray device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other objects, the invention has a prominent characteristic that bubbles are formed by heat generated according to a flow of an internal current density in the conductive ink in the ink chamber, not in the surface of electrode.

Another characteristic of the invention is that the nozzle plate is used for a common electrode and thus its surface is coated for the conductive layer.

Far another characteristic of the invention is that there is used the conductive ink containing a predetermined resistant substances.

Still another characteristic of the invention is that the nozzle plate is electrically separated from the individual electrode, formed on the different layers, and thus used for the common electrode to thereby generate bubbles in the ink, the surface wetting with the ink is formed as the conductive layer, and the other surface facing to media is formed as the insulating layer.

It is to be understood that both the foregoing general description and the following detailed description are exemplary and explanatory and are intended to provide further explanation of the invention as claimed.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
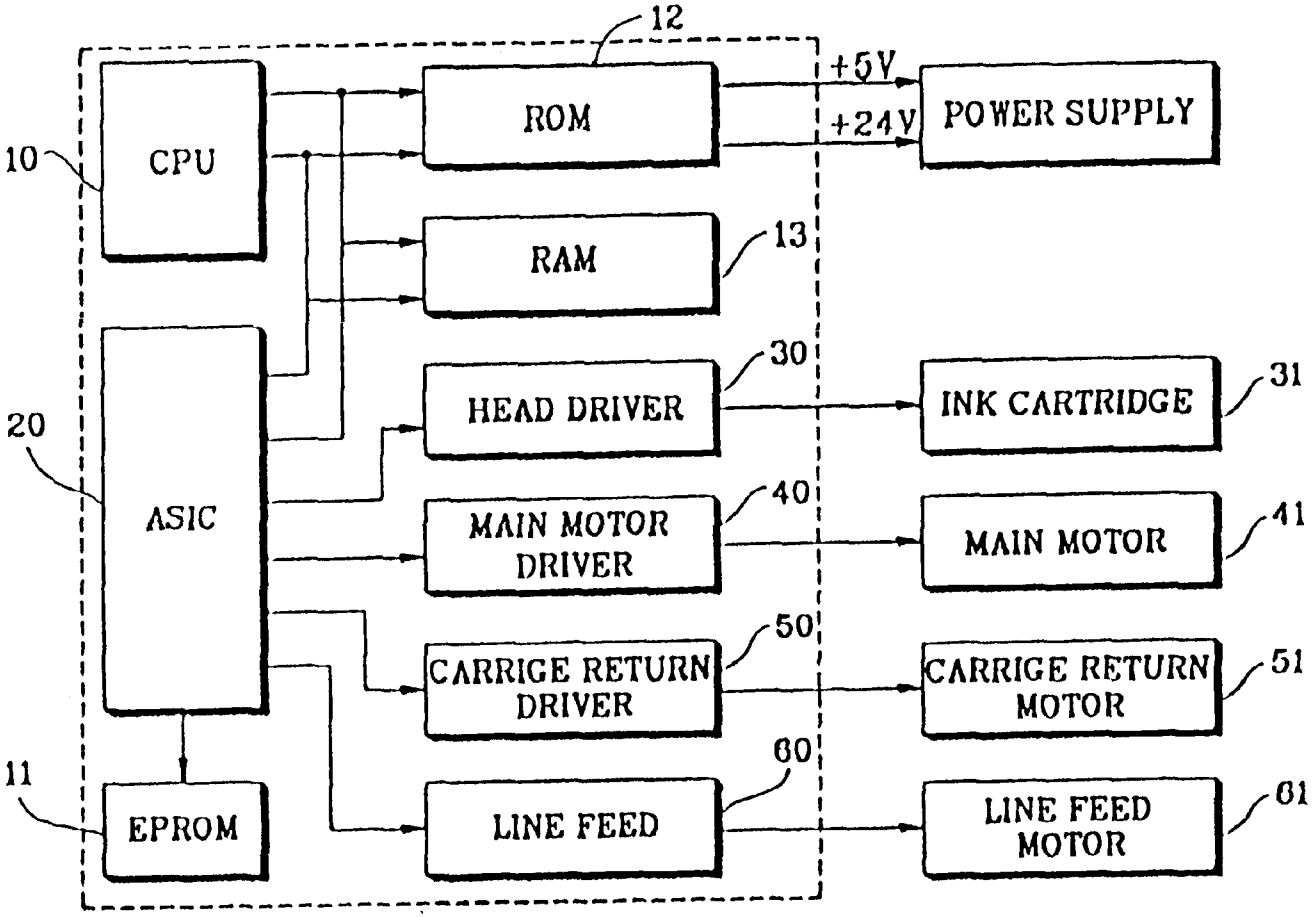
FIG. 1 is a block diagram illustrating the structure of a general inkjet printer.

First, the structure and operational principle of a general inkjet printer will be described below with reference to FIG. 1. An inkjet printer has CPU 10 for receiving a signal from a computer (not shown) through a printer interface, reading a system program in EPROM 11 which stores an initial value set for operating the printer and the system, analyzing them and working to output a control signal according to the content of the program; ROM 12 having a control program and several fonts; RAM 13 for temporarily storing data during the operation of the systems; an ASIC circuit part 20, in which most of the CPU-controlling logic circuits are realized in an ASIC form, for transmitting data from CPU 10 to the majority of the circuits around CPU 10; a head driver 30 for controlling an operation of an ink cartridge 31 according to a control signal of CPU 10 transmitted from the ASIC circuit part 20; a maintenance driving circuit 40 for protecting a nozzle of the ink cartridge 31 from an exposure to air by a driving circuit of a maintenance motor 41; a carriage motor driving circuit 50 for controlling an operation of a carriage return driving motor 51; and a line feed motor driving circuit 60 for controlling an operation of a line feed motor 61 for feeding/discharging paper by using a stepping motor.

Conventionally, there is used a method of applying a printing signal from the computer through the printer interface to drive each motor 40, 50 and 60 according to the control signal of CPU 10 and thus perform printing. Here, the ink cartridge 31 sprays fine ink drops through a plurality of openings in the nozzle, and thus forms dots.

Figure 2:
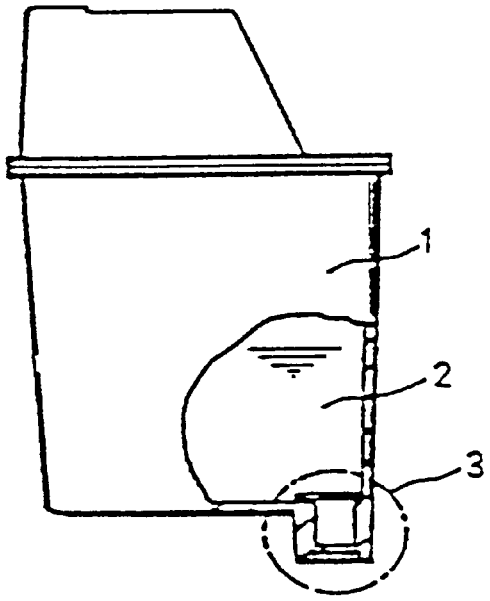
FIG. 2 is a schematic sectional view of an ink cartridge.
Figure 3:
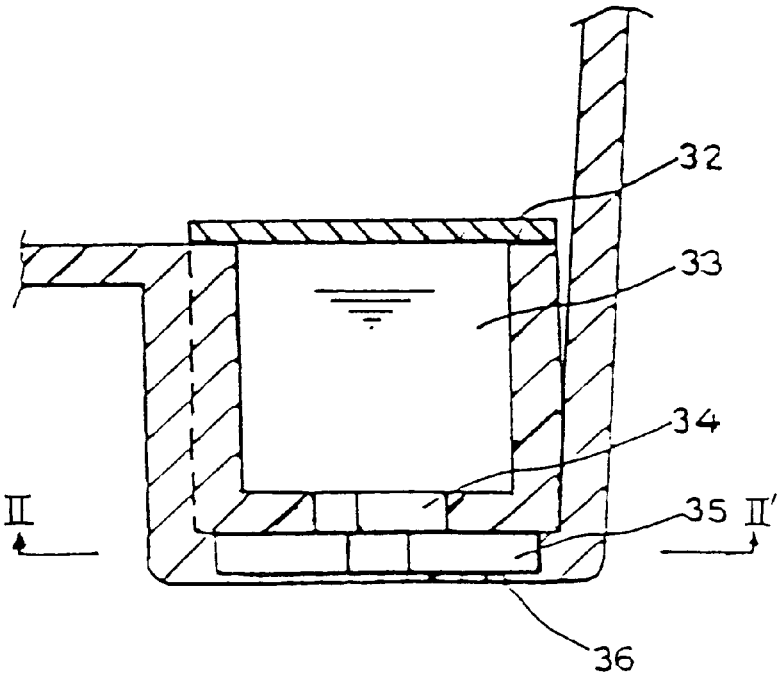
FIG. 3 is a explosive sectional view of a spray part in a conventional spray device.

As illustrated in FIG. 2, the ink cartridge includes a head part 3, and the ink 2 absorbed through a sponge in a case 1 forming an external profile of the container. As illustrated in FIG. 3, the head part 3 has a filter 32 for eliminating impurity materials mixed with the ink; an ink stand pipe chamber 33 for containing ink filtered through the filter 32; an ink via 34 for supplying ink transmitted through the ink stand pipe chamber 33 to an ink heating part and a chip 35 having the chamber; and a nozzle plate 36 having a plurality of openings for spraying ink of the heating part (not shown) transmitted from the ink via 34 to media.

Figure 4:
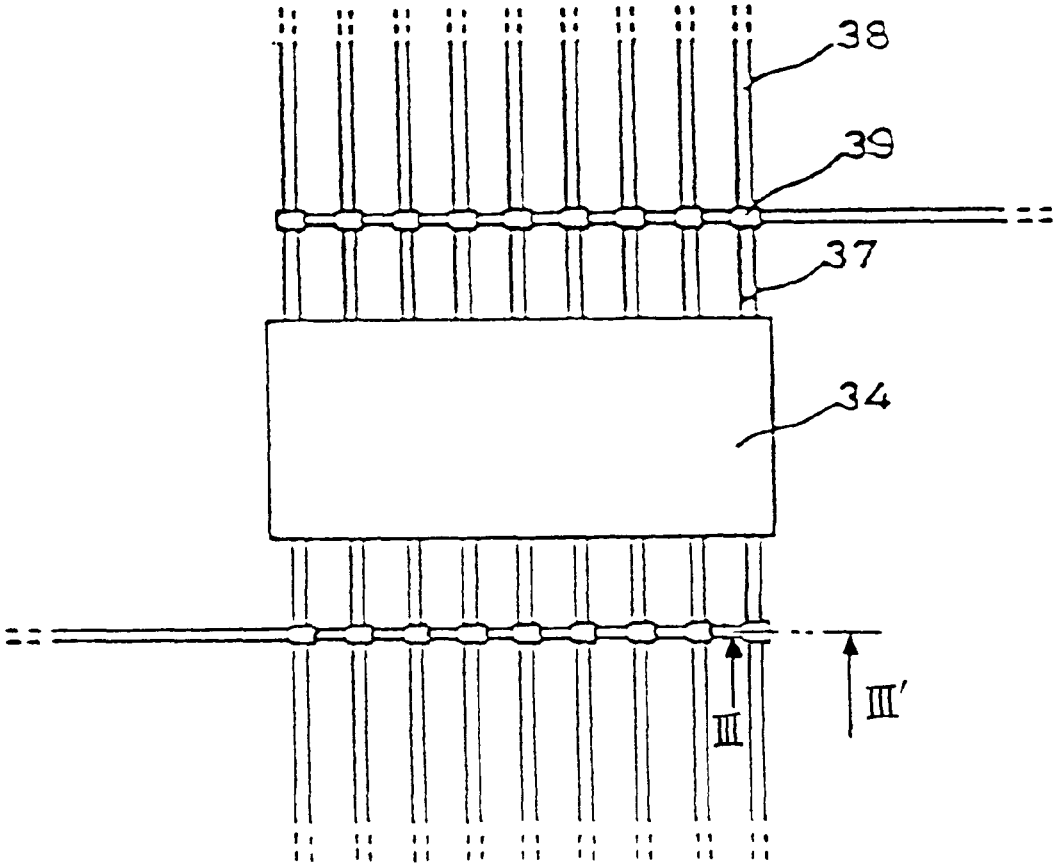
FIG. 4 is a plan sectional view taken along lines II-II' of FIG. 3.

FIG. 4 is a cross-sectional view as taken along line II-II' of FIG. 3, that depicts ink via 34 for supplying ink to an ink chamber (not shown) between the nozzle plate 36 and the chip 35; a plurality of ink channels 37 for supplying ink from the ink via 34 to each opening of the nozzle plate 36; a plurality of spraying parts 39 for spraying ink transmitted through the ink channels 37; and a plurality of electrically connecting means 38 for supplying power to the plurality of chips 35.

Figure 5:
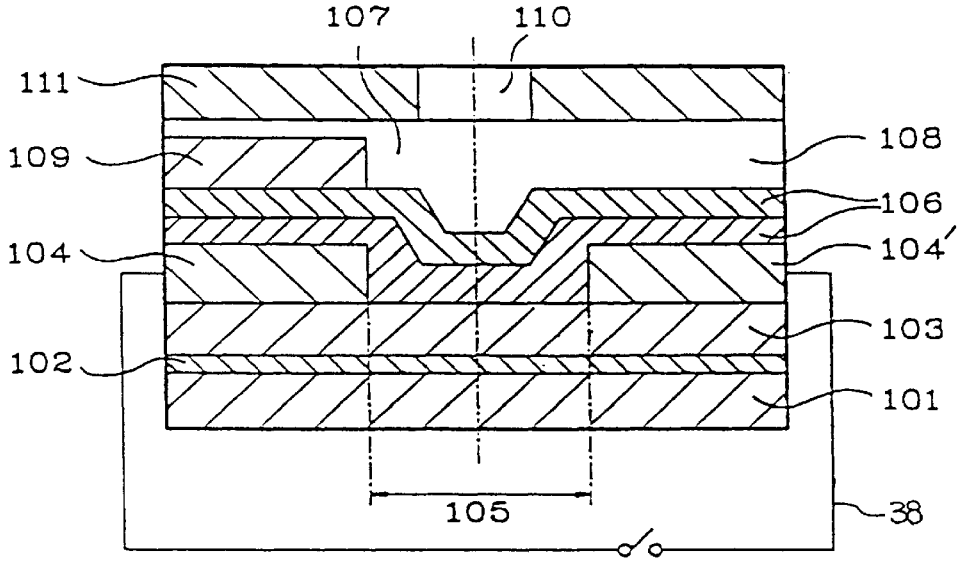
FIG. 5 is a cross sectional view taken along lines III-III' of FIG. 4.

FIG. 5 is an enlarged-sectional view of a spraying part 39 as taken along line III-III' of FIG. 4. As illustrated in FIG. 5, spraying part 39 includes a resistor layer 103 formed on an oxide layer ($SiO_2$) 102 on a silicon substrate 101 by an oxidation process and heated by electrical energy; two electrodes 104 and 104' are formed on the resistor layer 103 and are provided with an electrical connection with connectors 38; a protective layer of multi-layers 106 for preventing the electrodes 104 and 104' formed on resistor layer 103 from being etched and deformed by a chemical reaction to the ink; an ink chamber 107 for generating bubbles by the heat of the heating part 105; an ink channel 108 for flowing the ink in the ink via to the ink chamber 107; an ink barrier 109 serves as a wall to form a space for flowing the ink transmitted through the ink channel to the ink chamber 107; and a nozzle plate 111 having a plurality of openings 110 for spraying ink pushed out by the volume variation of bubbles in the ink chamber 107.

Here, the nozzle plate 111 and the heating part 105 are spaced apart at regular intervals to face each other. The pair of electrodes 104 and 104' are electrically connected to an external terminal bumper (not shown) and this bumper is connected to a head controller (not shown) so that the ink is sprayed from the each position in the nozzle openings. Meanwhile, each of the heating parts has the ink barrier 109 for guiding the ink from the side, and this ink barrier 109 is connected to a common ink via to guide the ink from the ink container.

Figure 6:
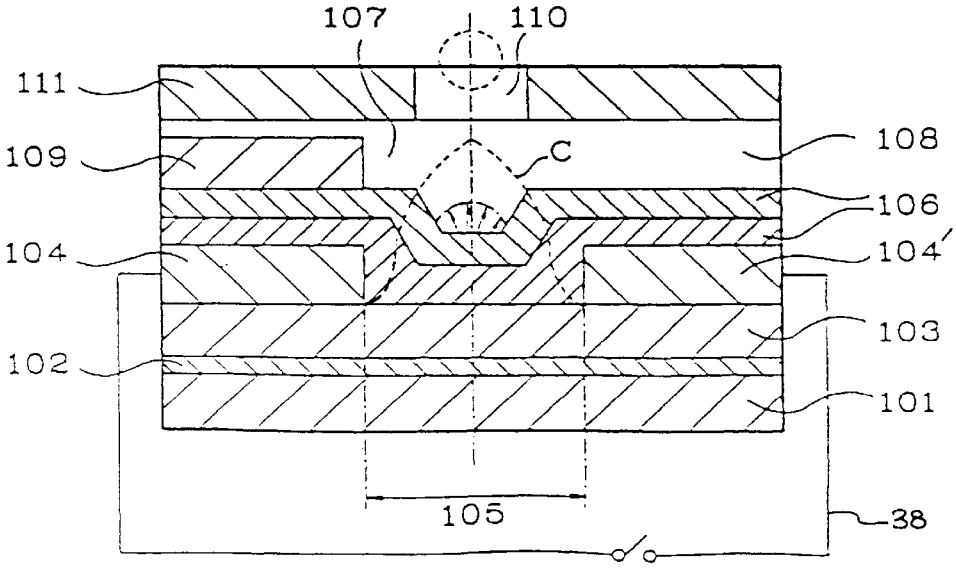
FIG. 6 is an exemplified view of an earlier ink spraying method.

The thus-structured earlier ink spray device sprays as follows. The initial head driver 30 transmits the electrical energy to the pair of electrodes 104 and 104' placed where the desired characters will be printed according to the control command of CPU 10 receiving the printing command through the printer interface. This power is transmitted through electrodes 104 and 104' and heats the heating part 105 by electrical resistance, i.e. joule heat for a predetermined time by the electrical resistance heat, namely, by $P=I^2R$. The surface of the heating part 105 is heated up to 500 to 550° C., and the heat conducts to the plurality of protective layers 106 thereon. Here, when the heat is applied to the ink adjacent to the protective layers, the distribution of the bubbles generated by the vapor pressure is highest in the center C, as shown in FIG. 6, regarding the center of the heating part 105 as a symmetrical axis. By the heat, the ink is heated and bubbles are formed, so that the volume of liquid ink on the heating part 105 is displaced by bubbles generated by vapor pressure. The ink pushed out by the volume variation is pushed out through the two openings 110 of the nozzle plate 111.

At this time, if the electrical energy supply to the two electrodes 104 and 104' is cut off, the heating part 105 is momentarily cooled and the expanded bubbles are accordingly contracted, thereby returning the ink to the original state.

The ink expanded and discharged out of the openings of the nozzle plate is sprayed to the media in the form of drop due to a surface tension, and forms an image. Due to an internal pressure decrease according to the volume corresponding to the bubbles, the ink is re-charged from the container via the ink via 34.

The above-mentioned conventional ink spraying method has the following problems First, is as the bubbles are formed by high temperature to thereby spray the ink, a thermal variation is in the content of the ink, and an impact wave generated in the ink by the bubbles causes the ink head structure to deform, vibrate, and fluctuate causing erosion and delamination of the layers. This may cause dissatisfaction in a user, who wants a high quality of printing. Second, the resistor layer 103 and the electrodes 104 and 104' lie adjacent to protective layer 106 are combined by an intermedium to react electrically with each other, and ions in the border layer of the heating part 105 and the two electrodes 104 and 104' move and cause the corrosion, thereby decreasing the lifetime of the head. Third, as the bubbles are made in the region external to heating part 105, the replenishing of the ink is delayed due to the impact of these bubbles. Fourth, the shape of the drop affects the advance, ring-shape and the uniformity of the drop quantity according to the shape of the bubbles, and therefore it affects the printing quality. Finally, since a plurality of protective layers are formed on the electrode and the resistor, the manufacturing procedures are complex, and costs for producing in a clean room are also increased.

Figure 7:
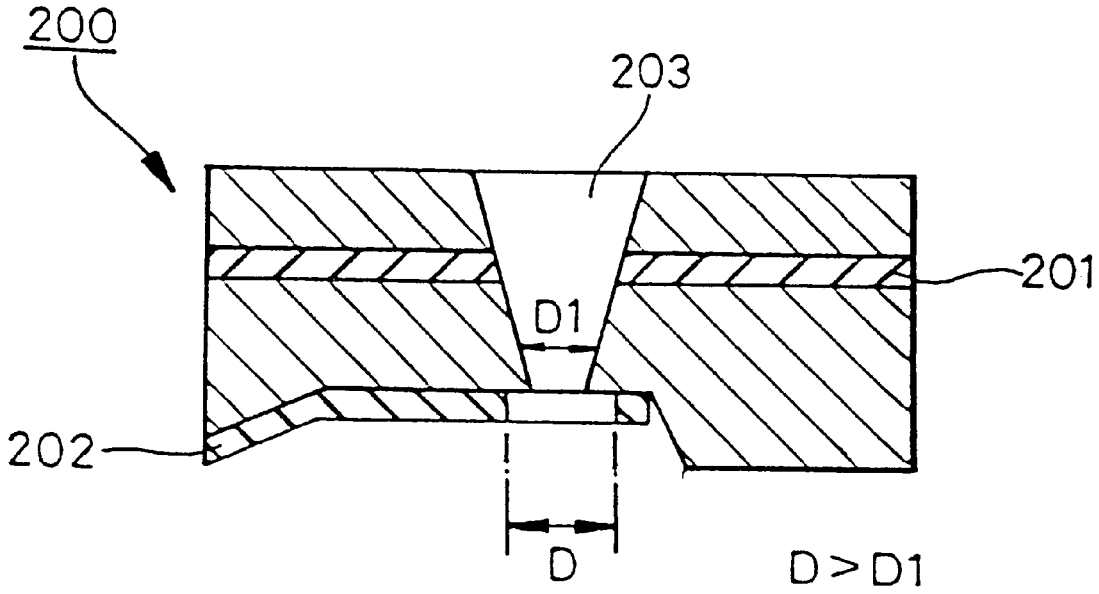
FIG. 7 illustrates a nozzle plate part of an improved conventional spray device.

To solve the above problems, an improved spray device is introduced with reference to FIG. 7. First and second electrodes 201 and 202 are formed on the upper/lower surfaces of a nozzle plate 200, so that a nozzle 203 is fabricated, using an excimer laser. Nozzle 203 is directly connected with an ink cartridge (not shown) to flow the conductive ink to the nozzle 203 by using capillary action. High voltage is applied to the two electrodes 201 and 202 to heat and evacuate the conductive ink, thus to spraying the ink in the nozzle on a paper by a vapor pressure. Here, the nozzle 203 takes the form of a taper whose upper sectional area making contact with the paper is greater than the lower sectional area. The voltage applied to the two electrodes is about 1000–3000 V, capable of operating up to 10 kHz.

But, by this method, as the ink in the nozzle is heated with the high voltage and sprays the ink in the nozzle onto the paper, the length of the nozzle should be long. And the sectional area of the lower electrode, namely a hole D of the second electrode connected to the nozzle is greater than a sectional area D1 of the lower part of the nozzle. Therefore, when a voltage is applied to each electrode, as it is difficult to center the current density, a high voltage is required. Moreover, if the nozzle plate having those two electrodes and the nozzle part is too thick, the processing time becomes longer, and its producing costs are accordingly increased.

Figure 8:
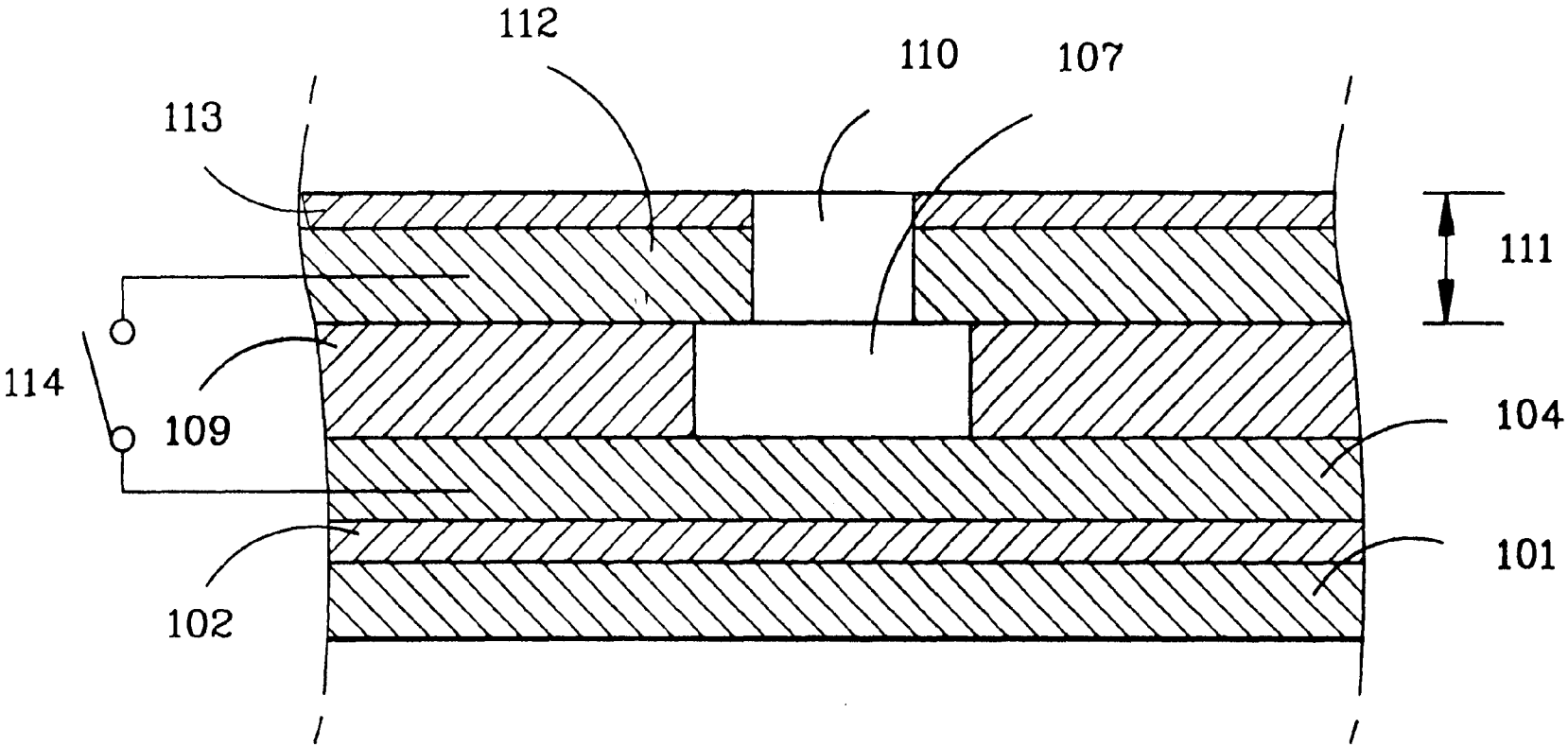
FIG. 8 is an explosive sectional view of a spray device according to an embodiment of the invention.

As illustrated in FIG. 8, a spray device for an inkjet printer includes: a plurality of individual electrodes 104 formed on an oxide layer $SiO_2$ 102 on a supporter of a silicon substrate 101, and having a predetermined portion wetted with an ink to generate bubbles in the ink and the rest insulated portion; a nozzle plate 111 having a plurality of openings 110 for spraying an ink to media, conductive layers 112 surrounding the openings, and insulating layers 113 covering the conductive layers, the nozzle plate being separated from the plurality of individual electrodes 104 and formed on the different layers, the nozzle plate having a predetermined portion wetted with the ink and serving as a common electrode to generate bubbles in the ink with electrical energy supplied from the individual electrodes; a barrier 109 for serving as a guiding wall, which electrically separates the portion wetted with the ink in the individual electrodes 104 from the adjacent individual electrodes 104 and supplies the ink transmitted from an ink via through an an ink channel to an ink chamber, improving the speed and direction of the ink ejected through opening 110; an ink chamber 107 for receiving the ink through the barrier 109 and generating bubbles by the current concentration between the individual electrodes 104 and the nozzle plate 111; and an electrical connecting means for supplying electrical energy to the individual electrodes 104 and the nozzle plate 111.

The entire surface of the nozzle plate 111 is equally coated by an insulating layer 113, and its internal side, namely, the side toward the ink chamber 107 is structured as a conductor, so that its manufacture and structure are simple, and the loss of power is prevented.

The conductive layer 112 fully covers the ink chamber 107, and conductive layer 112 does not overlap with adjacent ink chambers. It can prevent a concentration of a current density and a loss of power. Therefore, the invention can be driven with a low voltage, and the bubbles are formed uniformly throughout ink chamber 107, thus resulting in a net direction of travel of the ink drops that is perpendicular to nozzle plate 111. The material of the individual electrodes and the nozzle plate is made of alloys of Ni and Platinum to prevent a corrosion with the conductive ink.

A printing method of a general inkjet printer is the same as the earlier one. The invention is restricted to a head of the inkjet printer, so that the spray device of the inkjet printer will be described here. First, to perform printing on an intended position, namely, a preset position for printing, a head driver (not shown) supplies electrical energy signal to the corresponding individual electrode. Here, a voltage is applied to the electrodes of the corresponding position, namely, to the individual electrodes 104, and simultaneously a reverse polarity of voltage is applied to the conductive layer 112 of the nozzle plate 111 as the common electrodes. The voltage supplies power voltage below 100 V DC, and the current flowing in each electrode is below 5 A.

The current flows through the conductive ink wetting to electrically conduct between the individual electrodes and the common electrode and containing constant resistance components. The conductive ink has the conductivity by containing NaCl, so that it generates heat by the internal current and resistance. The heat is converted into the heat energy according to the following Joule's law: $P=I^2R$(P: Heat, I: Current, R: Resistance).

Figure 9:
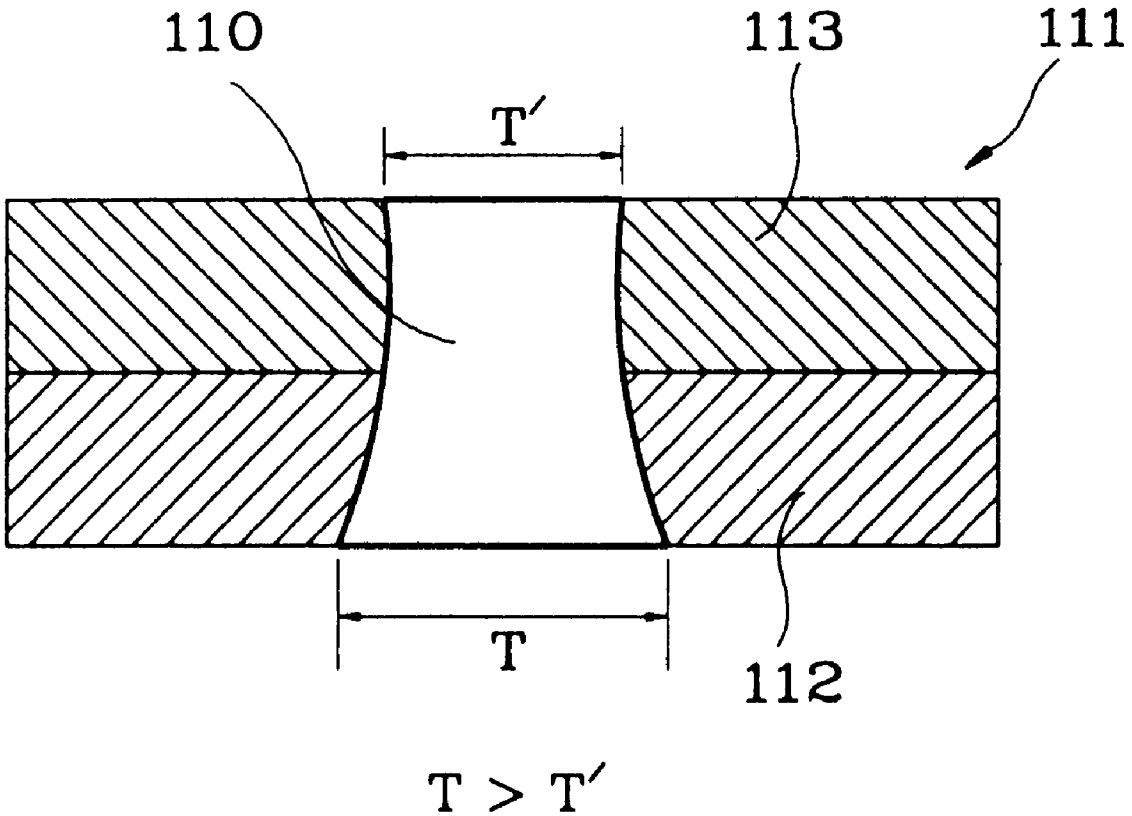
FIG. 9 is an explosive sectional view of a spray device according to another embodiment of the invention.

In the openings 100 in the nozzle plate 111, as illustrated in FIG. 9, the sectional area of the paper side T' is structured to be smaller than that T of the ink chamber side. Therefore, the straightness of the ink drop is increased.

The printing method of a general inkjet printer is the same as the earlier one. The invention is restricted to a head of the inkjet printer, so that the spray device of the inkjet printer will be described here. First, to perform printing on an intended position, namely, a preset position for printing, a head driver (not shown) supplies electrical energy signal to the corresponding individual electrode.

Figure 10:
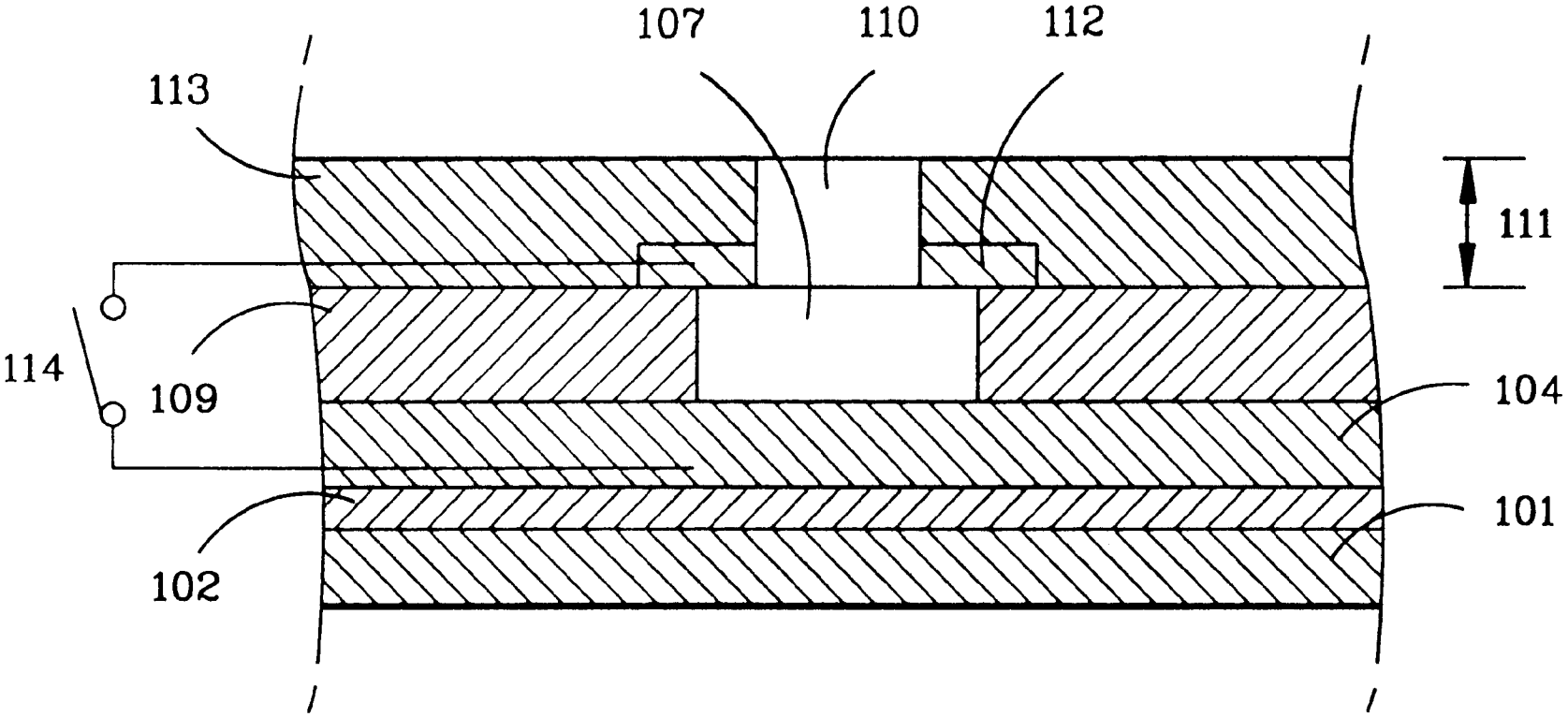
FIG. 10 is a top sectional view of the nozzle plate of FIG. 9.

Meanwhile, the different structure of the spray device of the inkjet printer of the invention will be described below with reference to FIG. 10. The structure of the embodiment of FIG. 10 is different from that of FIG. 8 in the aspect that the conductive layer 112 formed in the nozzle plate 111 having a plurality of openings 110 takes a donut form. This conductive layer 112 surrounds the openings 110. Therefore, the flow of the current density generated in the ink chamber 107 is not dissipated by the nozzle plate, so that the bubbles are more stably generated, and thus the printing is of high quality.

Figure 11:
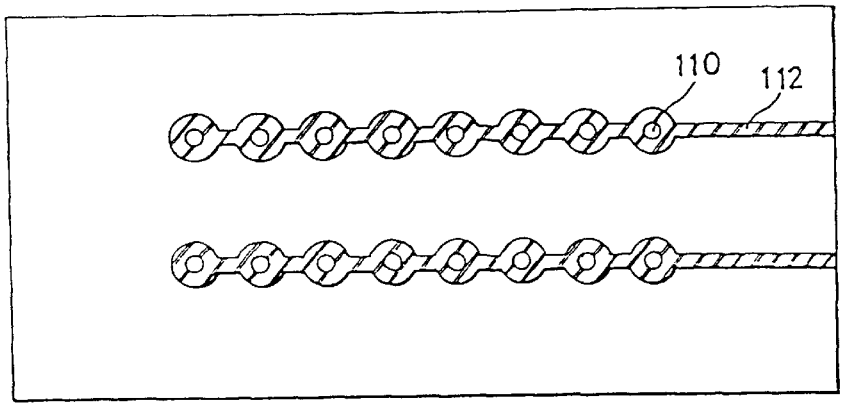
FIG. 11 is an exemplified view illustrating a method for spraying ink according to the invention.

FIG. 11 is a top sectional view of the nozzle plate 110 of FIG. 10, observing its openings from the top. As illustrated in the drawing, the conductive layer 112 surrounds the openings 110, as in the form of a donut.

Figure 12:
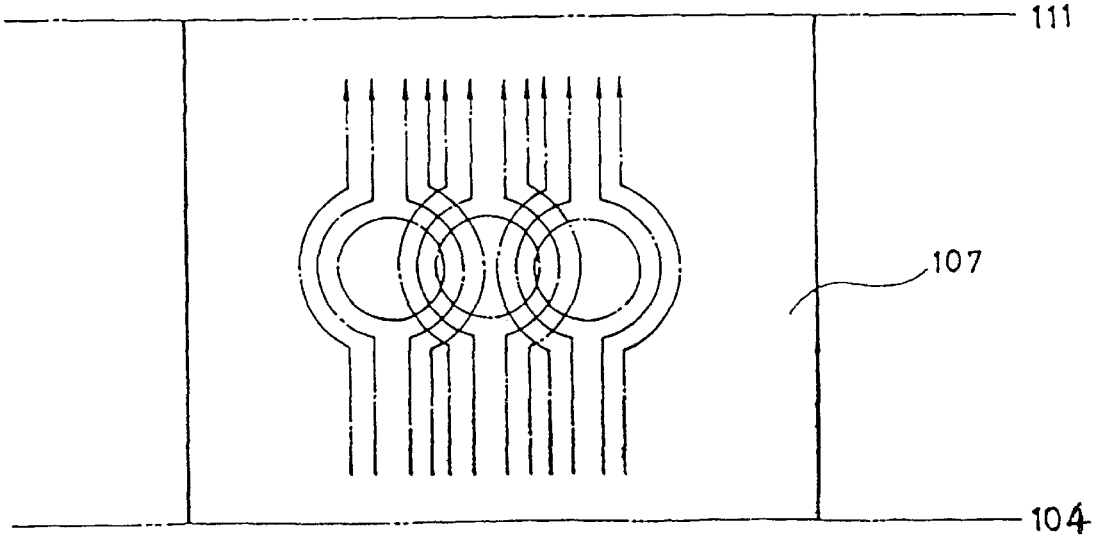
FIG. 12 is an illustration representing physical aspects in the formation of bubbles during operation of an embodiment constructed according to the principles of the present invention.

A specific method of forming the bubbles and performing printing of the invention of FIGS. 8 to 10, is illustrated below with reference to FIG. 12. The polarity of conductive layer 112 is opposite to that of electrode 104 to make the electrons flow when switch 114 is closed. In other words, if DC voltage is applied thereto, a difference of current density occurs in the direction from the individual electrodes 104 to the nozzle plate. Closing switch 114 causes a current to flow inside ink chamber 107 between conductive layer 112 and electrode 104. Since the ink is electrically restive, heat is generated in the ink upon closing switch 114. If the bubbles are formed in the ink chamber 107 between the individual electrodes 104 and the nozzle plate 111, the current density flows around the bubbles, not penetrating through the bubbles. Here, the current density is centered around the bubbles. Consequently, with the increasing current, the heat is successively increased around the place where bubbles are initially formed according to $P=I^2R$, accordingly increasing the bubbles. In other words, if the initial bubble is made, the peripheral current density is increased, and accordingly a great bubble is generated due to the combination or deformation of the bubbles, increasing the vapor pressure. By the energy applied for a predetermined time, bubbles are successively generated in the ink chamber 107 between two electrodes. Consequently, as the great vapor pressure is generated due to the bubbles, a volume variation occurs in the ink chamber 107, and the ink in the chamber 107 is pushed out of the openings 110 of the nozzle plate 111. The ink forms drops outside opening 110 as bubbles are produced inside ink chamber 107. As bubbles form in ink chamber 107, a rounded bubble is developed outside opening 110 due to the high viscosity of the ink. If the electrical energy applied to the individual electrodes is cut off, the bubbles in the chamber 107 disappear and the drops are interseparated in the nozzle part due to the internal pressure decrease, and then sprayed to media. At the same time, the ink is re-charged in the ink chamber 107 through the ink via and ink channel from the ink stand pipe chamber (not shown) due to the internal pressure decrease.

Through repeating the above-mentioned operations, the ink spraying and recharging operations are performed to realize an intended image on media. In other words, when the electrical energy applied between the individual electrodes 104 wetted with the ink in the ink chamber 107 and the conductive layer 112 of the nozzle plate 111 is converted into heat at a predetermined internal area through the conductive ink being an electrical medium between conductive layer 112 and electrode 104, the ink is heated and evacuated by the heat, generating bubbles, and then sprayed to the openings 110. The conductive layer 112 of the nozzle plate 111 is structured as a conductive layer in which only a part corresponding to the individual electrode 104 wetted with the ink is electrically conductive, so that the current and the heat generated in ink chamber 107 is symmetrical about opening 110, facilitating the high frequency operation.

Meanwhile, the insulating layer 113 of the nozzle plate 111 prevents a power leakage which may occur because of transporting media of high-temperature, high-dampness and low-resistance irregularly, thereby enhancing its efficiency.

As described above, in the structure for generating bubbles, while the conventional head is structured to heat the ink in a heater part made of electrodes and resistor, the invention electrically separates the nozzle plate operating as a common plate from the individual electrodes by using the insulating layer to apply a different polarity of power to the two electrodes, so that the current flow by the current density difference is used for generating bubbles, and the heat generated by the internal current and resistor components in the ink are used therefor. Accordingly, the invention needs no more protective layer for protecting the internal electrodes such as in the conventional head, and therefore there is no damage in the surface due to the heat generated from the heater part.

Furthermore, unlike conventional device, as the bubbles are generated and disappeared on the surface of the resistor heater in the invention, there is no problem that the surface of the resistor heater is damaged by its impact wave and decreases the lifetime. And the internal structure is simple and thus reduces the costs for manufacture and production.

Above all, most improved is the fact that the bubbles are successively generated in the ink according to the Joule's law. Moreover, the individual electrodes and the nozzle plate are electrically isolated so that they increase the density for generating the bubble, and always maintain a unique vapor pressure. Therefore, the straightness and the equal spraying speed are maintained. By structuring the conductive layer in a manner that the part wetted with the ink in the ink chamber 107 corresponds to the sectional area of the individual electrodes corresponding to the conductor and its lower part, the current density is increased. By supplying a low voltage, the bubbles are easily generated. Finally, the structure is simplified to facilitate the high frequency ink spraying operation, and increase yield in the manufacturing procedures.

It will be apparent to those skilled in the art that various modifications and variations can be made in the spraying device of an inkjet printer of the present invention without departing from the spirit or scope of the invention. Thus, it is intended that the present invention cover the modifications and variations of this invention provided they come within the scope of the appended claims and their equivalents.

What is claimed is:

1. A spray device of an inkjet printer, comprising:

a plurality of individual electrodes formed on a substrate and having a first predetermined portion wetted with ink to generate bubbles in the ink and a portion not wetted with ink serving as an insulating layer;

a nozzle plate perforated by a plurality of openings for spraying ink onto media, said nozzle plate having a doughnut shaped conductive layer surrounding each of the openings, said nozzle plate having an insulating layer covering the conductive layers on the side of the conductive layers away from said individual electrodes, the nozzle plate being separated from the plurality of individual electrodes, the nozzle plate having a second predetermined portion wetted with the ink and serving as a common electrode for generating bubbles by conduction of electricity through the ink with electrical energy supplied from the individual electrodes;

a barrier formed beneath said nozzle plate and above said plurality of individual electrodes for serving as a guiding wall, which electrically separates said first predetermined portion wetted with ink in the individual electrodes from adjacent individual electrodes and supplies the ink transmitted from an ink via through an ink channel to an ink chamber formed within said barrier, thereby increasing a spraying force in case of spraying the ink to the openings in the nozzle plate and providing a staightness of the vapor pressure;

said ink chamber for receiving the ink through the barrier and generating bubbles with the current density between the individual electrodes and the nozzle plate; and electrical connecting means connected to said plurality of individual electrodes for supplying electrical energy to the individual electrodes and the nozzle plate, wherein said doughnut shaped conductive layers prevent the dissipation of the current density in the ink chambers by said nozzle plate.

2. The device as claimed in claim 1, wherein the ink is a conductive ink and has a predetermined resistance value.

3. The device as claimed in claim 1, wherein said plurality of individual electrodes and said conductive layers of said nozzle plate are made of an alloy of Ni and Platinum to prevent a corrosion due to a contact with the ink.

4. The device as claimed in claim 1, wherein the ink contains NaCl to enable said ink to be more conductive.

5. The device as claimed in claim 1, wherein bubbles in the ink are generated in the ink chamber between the individual electrodes and the nozzle plate.

6. The device as claimed in claim 1, wherein the bubbles are formed by heat resulting from the current flow within the ink.

7. The device as claimed in claim 1, wherein voltage applied to the individual electrodes and the conductive layers of the nozzle plate are driven by direct current voltage below 100 V.

8. The device as claimed in claim 1, wherein current applied to the individual electrodes and the conductive layers of the nozzle plate is less than 5 A.

9. The device as claimed in claim 1, wherein the barrier is adhered to the nozzle plate with glue.

10. The device as claimed in claim 9, wherein the barrier and the nozzle plate are sealed in a thermosetting method.

11. The device as claimed in claim 1, wherein the conductive layer surrounds each opening in the nozzle plate.

12. The device as claimed in claim 1, wherein the conductive layer is in the form of a circle, surrounding each opening in the nozzle plate.

13. A spraying method of an inkjet printer, comprising the steps of:

forming a plurality of individual electrodes as a first layer and a nozzle plate as a second and separate layer with a barrier layer sandwiched between said nozzle plate and said plurality of individual electrodes;

forming the nozzle plate having a doughnut shaped conductive layer and an insulating layer, and supplying the different voltage potential to the conductive layer of the nozzle plate than to the plurality of individual electrodes to perform printing;

generating a concentrated current flow perpendicular to the nozzle plate through ink in an ink chamber;

generating bubbles by using heat energy generated in the ink by said current flow; and spraying the bubbles to the openings in the nozzle plate, wherein sad doughnut shaped conductive layer prevents the dissipation of the current density in the ink chamber by said nozzle plate.

14. An ink spraying device, comprising:

a substrate;

a lower electrode formed on said substrate;

a barrier layer formed on a portion of said lower electrode, said barrier layer defining a wall of a first ink chamber located above a portion of the lower electrode not covered by the barrier layer; and a nozzle plate formed over said barrier layer and having an opening connecting to the first ink chamber, said nozzle plate comprising:

a doughnut shaped conductive layer formed on a portion of said barrier layer surrounding the opening, for conducting electricity through a conductive ink to said lower electrode and heating the ink by resistive heating in the ink; and an insulating layer formed on said conductive layer and on a portion of said barrier layer not covered by the conductive layer, wherein said doughnut shaped conductive layer prevents the dissipation of the current density in the ink chamber by said nozzle plate.

15. The ink spraying device of claim 14, further comprising:

said nozzle plate being shaped such that the opening has a smaller sectional area on the side of the nozzle plate opposite the ink chamber than on the ink chamber side of the nozzle plate, said ink chamber having a larger opening than an opening for a nozzle hole on said ink chamber side of said nozzle plate.

16. The ink spraying device of claim 15, said opening having curved sides in a cross-section taken perpendicular to the surface of said lower electrode.

17. The ink spraying device of claim 14, further comprising:

said conductive layer being formed in the shape of a donut around the opening.

18. The ink spraying device of claim 14, further comprising:

a second lower electrode formed on the substrate;

said barrier layer being shaped to define a second ink chamber above a portion of the second lower electrode not covered by the barrier layer;

said nozzle plate being formed over said second lower electrode and having a second opening formed over the second ink chamber.

19. The ink spraying device of claim 18, said nozzle plate further comprising:

a second conductive layer formed on the barrier layer surrounding the second opening, said second conductive layer not overlapping the conductive layer formed on the first ink chamber.

20. The ink spraying device of claim 19, said conductive layers being formed in the shape of donuts around their respective openings.

21. An ink-jet printhead, comprising:

a substrate;

an insulating layer formed on said substrate;

a first electrode formed on said insulating layer;

a barrier layer formed on said first electrode being perforated by an ink chamber having a first diameter;

a nozzle plate formed over said barrier layer, said nozzle plate being perforated by a hole having a second diameter smaller than said first diameter, said nozzle hole being concentric with said ink chamber in said barrier layer, said nozzle plate having a doughnut shaped second electrode on a side of said nozzle plate facing said ink chamber, said nozzle plate having an insulating layer on a side facing away from said ink chamber;

an electrical circuit that provides DC pulses to said first electrode relative to said second electrode; and ink filling said ink chamber having a resistivity allowing a potential drop across said ink in said ink chamber upon application of DC pulses by said electrical circuit, wherein said doughnut shaped second electrode prevents the dissipation of the current density in the ink chamber by said nozzle plate.

22. The printhead of claim 21, wherein NaCl is added to said ink to foster generation of bubbles within said ink chamber.

23. The printhead of claim 21, wherein said second electrode having a donut shape.

24. The printhead of claim 21, wherein said electrical circuit applying a DC voltage of 100 volts and 5 amps of current at a frequency in excess of 10 kHz results in ink boiling inside said chamber with each pulse leading to expulsion of a droplet of ink with each pulse applied.

* * * * *